United States Patent [19]

Synofzik et al.

[11] Patent Number: 4,805,532

[45] Date of Patent: Feb. 21, 1989

[54] DEPLOYING ARRANGEMENT FOR AN ON-BOARD TARGETING DEVICE OF A BOMBLET

[75] Inventors: Reinhard Synofzik; Manfred Busch, both of Jüchen, Fed. Rep. of Germany

[73] Assignee: Rheinmetall GmbH, Düsseldorf, Fed. Rep. of Germany

[21] Appl. No.: 141,376

[22] Filed: Jan. 7, 1988

[30] Foreign Application Priority Data

Jan. 8, 1987 [DE] Fed. Rep. of Germany ..... 3700342

[51] Int. Cl.[4] ..... F42B 25/20; F42C 13/02

[52] U.S. Cl. ..... 102/213; 102/387; 102/393

[58] Field of Search ..... 102/213, 214, 386, 387, 102/388, 393

[56] References Cited

U.S. PATENT DOCUMENTS 4,587,902 5/1986 Lindner et al. ..... 102/213
4,691,636 9/1987 Witt et al. ..... 102/214

FOREIGN PATENT DOCUMENTS 3428051 3/1986 Fed. Rep. of Germany .

*Primary Examiner*—Charles T. Jordan

*Attorney, Agent, or Firm*—Spencer & Frank

[57] ABSTRACT

A bomblet has a casing and a targeting device provided with a reflector swingably secured to the casing. The reflector has a position of rest in which it is situated within a cross-sectional outline of the casing and a working position in which it is in a deployed state externally of the casing. A first guide arm is articulated to the reflector to provide for a relative pivotal motion about a first pivotal axis, and to the casing to provide for a relative pivotal motion about a second pivotal axis. A second guide arm is articulated to the reflector to provide for a relative pivotal motion about a third pivotal axis, and to the casing to provide for a relative pivotal motion about a fourth pivotal axis. All the pivotal axes are parallel to and spaced from one another and are perpendicular to the central longitudinal axis of the bomblet. The guide arms guide the reflector in a swinging motion from the position of rest into the working position. The reflector has a center of gravity located, in the position of rest, offset from the longitudinal axis in a direction of the swinging motion, whereby, upon rotary motion of the bomblet, the reflector is moved by centrifugal forces from the position of rest into the working position. Further, a locking engagement is provided for immobilizing the reflector in the working position.

8 Claims, 3 Drawing Sheets

DEPLOYING ARRANGEMENT FOR AN ON-BOARD TARGETING DEVICE OF A BOMBLET

BACKGROUND OF THE INVENTION

This invention relates to a bomblet having a casing of essentially rotational symmetrical cross section and a targeting device which includes a reflector (antenna) articulated to the casing. During a rotary motion of the bomblet, in response to an applied force, the reflector swings from a space-saving position of rest in the casing into a working position in which the reflector is locked. The reflector has an effective surface which, in the working position, is oriented towards the target zone and which projects beyond the cross section of the bomblet casing. A bomblet of this type is disclosed, for example, in German Offenlegungsschrift (non-examined published application) No. 3,428,051.

Bomblets equipped with an on-board targeting device are preferably used from the air against armored ground targets. Generally, for the transport over the target zone, a plurality of bomblets is accommodated within a container, for example, a rocket or the carrier casing of an artillery shell and is ejectable therefrom above the target zone at a predeterminable altitude. The bomblets then drop individually while rotating about their respective central longitudinal axis and cooperate with a mechanism which reduces their falling speed and rate of rotation.

A short period after the bomblet leaves the transport container such as a rocket or the casing of an artillery shell, the on-board targeting device of the bomblet is activated in such a manner that as the bomblet approaches the target, a signal characterizing the target may be received thereby.

In the above-noted German Offenlegungsschrift No. 3,428,051 various mechanisms are described for deploying (unfolding) an antenna of a targeting device from the inside of the bomblet casing into a working position externally thereof and to immobilize the antenna in such a deployed position.

It is a common characteristic of the described mechanisms that for initiating and carrying out the deployment of the antenna, they need an additional energy source contained in the bomblet. Thus, by igniting a pyrotechnical charge or by releasing a highly pressurized gas, a desired gas pressure is set in a gas pressure actuated plunger which operates a piston system. The resulting motion of a piston rod is converted by various mechanical means into a deploying (unfolding) motion of the antenna.

In one of the embodiments described in the Offenlegungsschrift No. 3,428,051 the immobilization of the antenna deployed into its working position depends from the terminal position of the piston rod. According to another embodiment, the deployed antenna is held in its working position by a spring loaded pin.

It has been found that in a bomblet in accordance with German Offenlegungsschrift No. 3,428,051 the positioning of the antenna is not reproducible in a satisfactory manner. First, the additionally needed energy source for deploying the antenna poses problems such as the unavoidable risks of a malfunctioning in the ignition or possible irregularities in the burning behavior of the propellant. Second, during the fall of the bomblet, a resetting force, derived from the air resistance acts on the deployed antenna; such a resetting force has to be compensated for by a counterforce in the locking support.

Such a counterforce is generated according to one embodiment described in the Offenlegungsschrift No. 3,428,051 by the pressure force of the propellant gases, acting on the piston. This means that an accurate immobilization of the antenna may be assured only if the pressure of the propellant gases can be held constant. This, however, is not possible in practice.

Another type of immobilization of the antenna described in another embodiment, involving a spring-loaded locking pin is also wrought with problems because in case of a long-term storage of the bomblet a weakening of the armed spring of the locking pin may occur.

SUMMARY OF THE INVENTION

It is an object of the invention to provide an improved bomblet of the above-outlined type wherein the pivotal deployment motion of the reflector is effected without the use of an additional energy source and a reliable locking in the working position is ensured in a simple manner without the use of components which are prone to "tiring" during long-term storage.

This object and others to become apparent as the specification progresses, are accomplished by the invention, according to which, briefly stated, the bomblet has a casing and a targeting device provided with a reflector swingably secured to the casing. The reflector has a position of rest in which it is situated within a cross-sectional outline of the casing and a working position in which it is in a deployed state externally of the casing. A first guide arm is articulated to the reflector to provide for a relative pivotal motion about a first pivotal axis, and to the casing to provide for a relative pivotal motion about a second pivotal axis. A second guide arm is articulated to the reflector to provide for a relative pivotal motion about a third pivotal axis, and to the casing to provide for a relative pivotal motion about a fourth pivotal axis. All the pivotal axes are parallel to and spaced from one another and are perpendicular to the central longitudinal axis of the bomblet. The guide arms guide the reflector in a swinging motion from the position of rest into the working position. The reflector has a center of gravity located, in the position of rest, offset from the longitudinal axis in a direction of the swinging motion, whereby, upon rotary motion of the bomblet, the reflector is moved by centrifugal forces from the position of rest into the working position. Further, a locking engagement is provided for immobilizing the reflector in the working position.

DESCRIPTION OF THE PREFERRED EMBODIMENT

Figure 1:
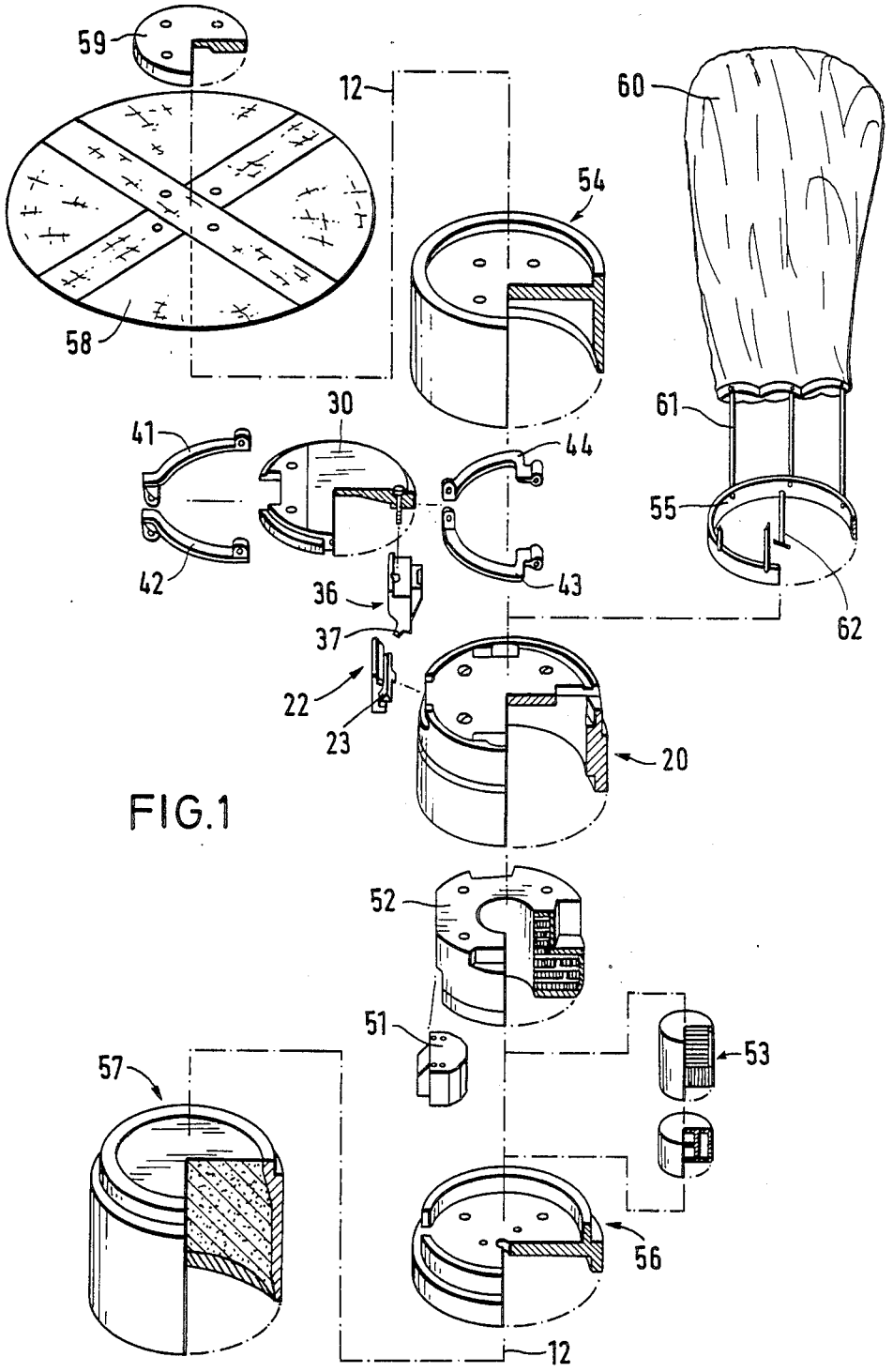
FIG. 1 is an exploded perspective view, partially in section, of a preferred embodiment of the invention.

Turning to the exploded view of FIG. 1, there are shown the individual components of a bomblet according to a preferred embodiment, with their position related to the central axis 12.

The bomblet has a payload body 57 which, during the descent of the bomblet, is oriented towards the target and which is connected with a bomblet casing 20 by means of an adapter 56. In the casing 20 there is disposed an electronic component 52 with a sensor component 51 and an energy supplying device 53 which, together with a reflector 30 form a targeting device.

Figure 2:
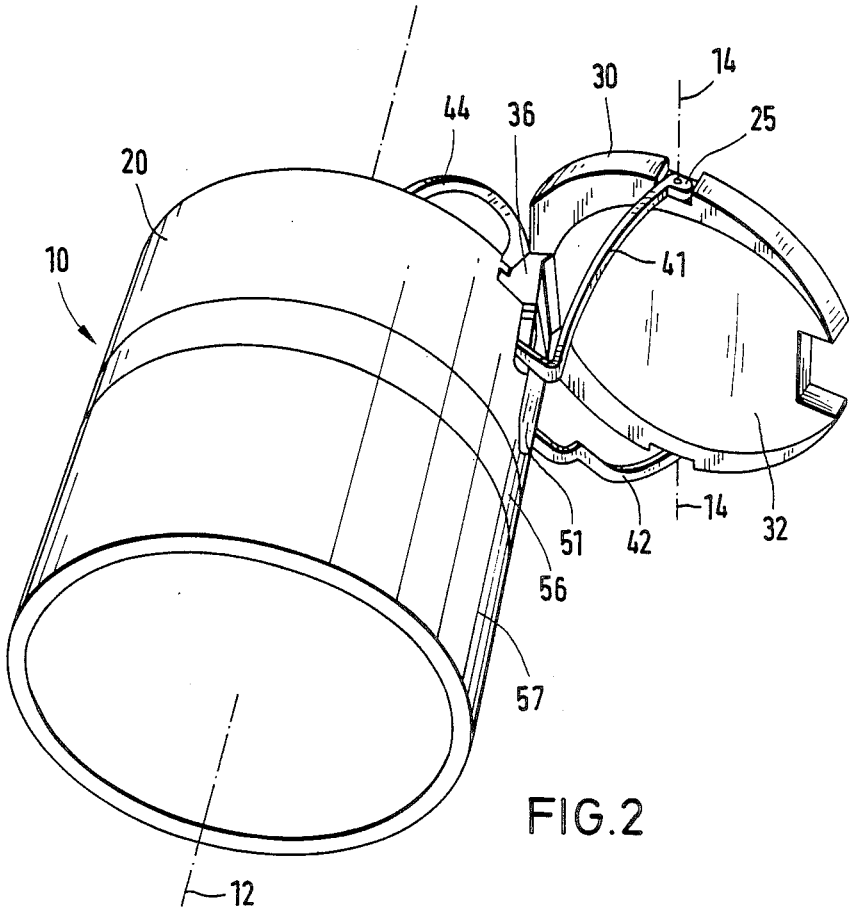
FIG. 2 is a perspective view of the preferred embodiment, shown in a deployed state (working position).
Figure 4:
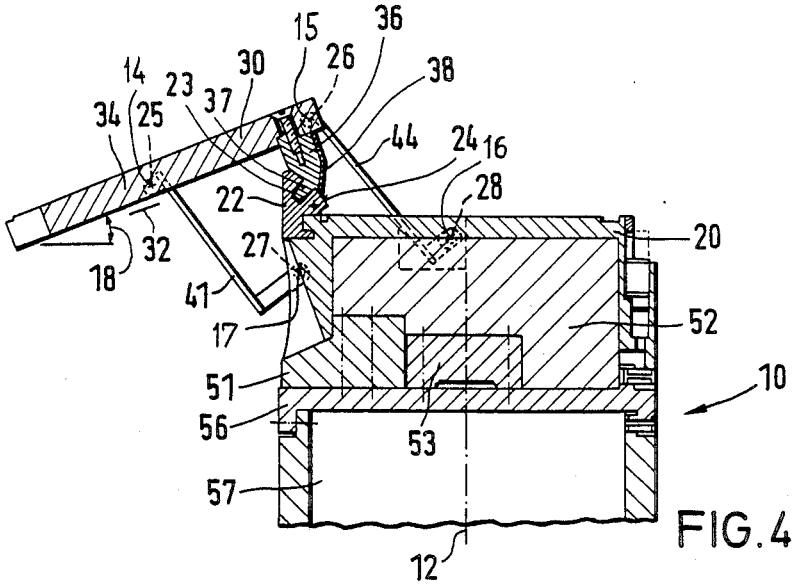
FIG. 4 is a schematic axial elevational view of the preferred embodiment in the deployed state.

As also shown in FIGS. 2 and 4, the reflector 30 is articulated to the casing 20 by means of four guide arms 41, 42, 43 and 44. The guide arms 41 and 42 are articulated to diametrically opposite locations of the reflector 30 by joints 25 to define a pivotal axis 14. The respective other ends of the guide arms 41 and 42 are articulated by joints 27 to casing 20 to define a pivotal axis 17. The guide arms 43 and 44 are jointed at 26 to the reflector 30 at a rear part thereof and define a pivotal axis 15. The respective other ends of the guide arms 43 and 44 are articulated to the bomblet casing 20 by joints 28 to define a pivotal axis 16. All pivotal axes 14, 15, 16 and 17 are parallel-spaced from one another and are oriented perpendicularly to the plane which lies in the drawing FIG. 4 and which contains the longitudinal axis 12.

On the casing 20 there is mounted a locking support 22 which has a groove 23. A corresponding countersupport 36 with a tongue 37, aided by a leaf spring 38 is secured to the reflector 30 in an edge zone thereof, adjacent the joints 26.

To the casing 20 there is further secured a mounting ring 55 which is connected with a self-rotating parachute 60 by means of cords 61. The mounting ring 55 is connected with the casing 20 by straps 62. On the side oriented towards the target, the casing 20 is closed off by a support construction 54 to which there is secured, by means of a mounting disc 59, a spin-braking disc 58 made of fabric.

After the ejection of the bomblet from a container such as a rocket or the casing of an artillery shell, the spin-braking disc 58 unfolds. As a result, the initially high dropping speed and rpm of the bomblet are reduced in a predetermined manner. The support construction 54 is released from the casing 20 and the self-rotating parachute 60 is deployed and reduces further the falling speed of the bomblet, whereby a small, essentially constant rpm of the bomblet is set. The reflector 30 which is still in its position of rest inside the casing 20 is no longer prevented from starting and executing its motion of deployment. The centrifugal force derived from the rotary motion of the bomblet and applied to the center of gravity 34 of the reflector 30 causes a pivotal motion of the latter. Thus, the reflector 30 is, by virtue of a parallelogram guidance which is known by itself and which is effected by the guide arms 41, 42, 43 and 44, moved from its position of rest in the inside of the casing 20 into a working position externally thereof as shown in FIGS. 2 and 4. The reflector 30 is in its working position immobilized in a simple and reliable manner in that the tongue 37 of the countersupport 36 affixed to the reflector 30 frictionally engages into the corresponding groove 23 of the immobilizing support 22 affixed to the casing 20.

Advantageously, the effective surface 32 of the reflector 30 is of paraboloidal configuration. The reflector 30 is, in its working position, inclined towards the target zone in such a manner that the central longitudinal axis 12 of the bomblet does not perpendicularly intersect an imaginary plane in which the edge of the effective surface 32 lies. The paraboloidal effective surface 32 of the reflector 30 inclined in this manner makes possible an advantageous reflection of target-characteristic signals, for example, waves in the millimeter length range or optical range to the sensor component 51 disposed in the casing 20.

Figure 3:
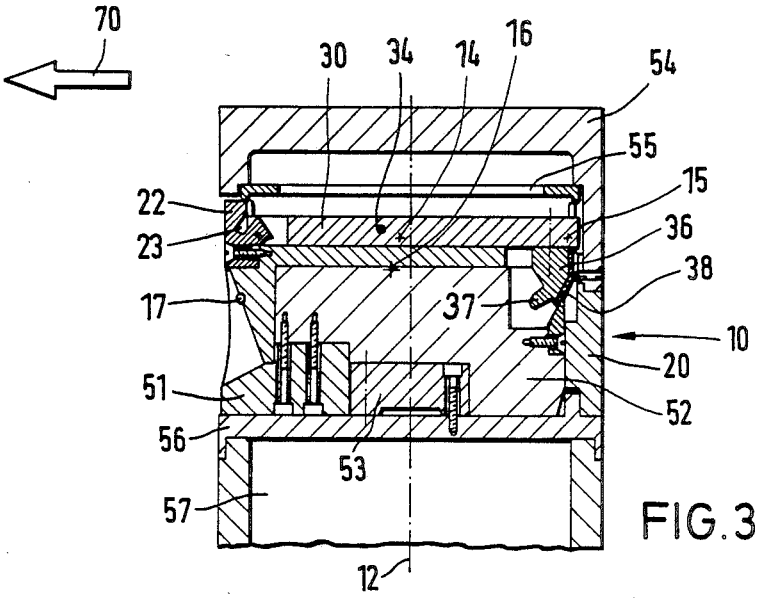
FIG. 3 is a schematic axial sectional view of the preferred embodiment in a folded state (position of rest).

In FIG. 3 the reflector 30 is in its position of rest inside the bomblet casing 20. The pivotal motion of the reflector 30 is in the plane of the drawing FIG. 3 which also contains the center of gravity 34 of the reflector 30. The center of gravity 34 is situated externally of the longitudinal central axis 12 of the bomblet 10 and is displaced eccentrically on a diameter of the casing 20 in the direction 70 of the pivotal motion of the reflector 30. The leaf spring 38 mounted on the rear part of the counter-support 36 is in a relaxed state and the effective face 32 of the reflector 30 is oriented towards the payload 57. The reflector 30 is retained within the confines of the casing 20 by the mounting ring 55 and the support construction 54 and is prevented from movement out of such position of rest.

After ejection of the bomblet 10 from the transport container, and subsequent to the release of the support construction 54 and the removal of the mounting ring 55 from the casing 20, the centrifugal force derived from the rotary motion of the bomblet 10 about the central longitudinal axis 12 affects the reflector 30 at the center of gravity 34. By virtue of such centrifugal force at the center of gravity 34 of the reflector 30 a torque is generated about the rotary axes 14, 15, 16 and 17, as a result of which the reflector 30 is pivoted from its position of rest in the inside of the casing 20 into its working position externally of the casing 20 as illustrated in FIG. 4. During the pivotal motion in the direction 70 the center of gravity 34 of the reflector 30 moves along a generally elliptical path in the plane of the drawing.

FIG. 4 illustrates the reflector 30 in its deployed, immobilized position. The effective surface 32 of the reflector 30 is oriented towards the target zone and forms an angle 18 with an imaginary plane oriented perpendicularly to the central axis 12 of the bomblet 10. In the illustrated working position the reflector 30 is immobilized by virtue of the fact that the tongue 37 of the countersupport 36 affixed to the reflector 30 frictionally engages into the groove 23 of the locking support 22 affixed to the casing 20. The leaf spring 38 mounted on the countersupport 36 lies against an edge 24 of the locking support 22, oriented towards the inside of the casing 20 and additionally secures the arresting arrangement from accidental release.

Thus, in the deployed state of the reflector 30 the tongue 37 engages with very narrow tolerances into the complemental, inwardly tapering and thus cross-sectionally wedge-shaped groove 23 for immobilizing the reflector 30 in its working position by frictional engagement between groove and tongue. Such cooperating frictional engagement between the tongue 37 and the groove 23 ensures that the angle between the effective surface 32 of the reflector 30 and the sensor component 51 can be set in a very accurate manner. The very high precision of such angle which is achievable by the described immobilizing mechanism and which must be maintained also during the drop of the bomblet is decisive of the efficiency of the bomblet as concerns an accurate target recognition.

Furthermore, the required high accuracy of the aforementioned angle between the effective surface 32 of the reflector 30 and the sensor component 51 cannot be achieved by the guiding effect of the four guide arms 41–44 since the manufacturing tolerances for the joints 25, 26, 27 and 28 have to be selected such that any risk of jamming of the reflector 30 in its motion from the folded position into the deployed position is securely eliminated. Consequently, the manufacturing tolerances of these joints are greater than those of the wedge connection between the tongue 37 and the groove 23.

As the bomblet 10 falls, the reflector 30 projecting laterally from the casing 20 and immobilized in its working position presents an aerodynamic resistance so that the air stream generates a torque acting on the flanks of the tongue 37. Such torque forces the tongue 37 into the groove 23 and by virtue of the friction between the tongue 37 and the wedge-shaped groove 23 a reverse rotation of the reflector is prevented. Such a wedging arrangement and thus the secure immobilization of the reflector in its working position is supported by the leaf spring 38 which additionally attempts to rotate upwardly the tongue 37 resulting in an additional wedging of the tongue 37 in the groove 23.

The shortest distance of the joint 25 (pivotal axis 14) at the reflector 30 to the joint 27 (pivotal axis 17) at the casing 20 is the length of the orthogonal projection of the guide arm 41 onto a plane which contains the central axis 12 and which is perpendicular to the pivotal axes 14–17. The shortest distance between the joint 26 (pivotal axis 15) at the reflector 30 and the joint 28 (pivotal axis 16) at the casing 20 is the length of the orthogonal projection of the guide arm 44 onto the above-noted plane (which is the drawing plane of FIG. 4). In order to obtain an optimal angle of inclination 18 of the effective surface 32 of the reflector 30 it is particularly advantageous to dimension the above-defined length of the guide arm 41 such that it is not more than 1.2 times greater than the above-defined length of the guide arm 44.

The present disclosure relates to subject matter contained in Federal Republic of Germany Patent Application No. P 37 00 342.9 (filed Jan. 8th, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a bomblet having a central longitudinal axis, a casing and a targeting device including a reflector and coupling means swingably securing said reflector to said casing; said reflector having a position of rest in which it is situated within a cross-sectional outline of the casing and a working position in which it is in a deployed state externally of said cross-sectional outline; the improvement wherein said coupling means comprises a first guide arm articulated to said reflector to provide for a relative pivotal motion between the first guide arm and the reflector about a first pivotal axis, said first guide arm being articulated to said casing to provide for a relative pivotal motion between the first guide arm and the casing about a second pivotal axis, a second guide arm articulated to said reflector to provide for a relative pivotal motion between the second guide arm and the reflector about a third pivotal axis, said second guide arm being articulated to said casing to provide for a relative pivotal motion between the second guide arm and the casing about a fourth pivotal axis; said first, second, third and fourth pivotal axes being parallel to and spaced from one another and being perpendicular to said central longitudinal axis; said first and second guide arms being arranged for guiding said reflector in a swinging motion from the position of rest into the working position; said reflector having a center of gravity located, in said position of rest, offset from said central longitudinal axis in a direction of said swinging motion, whereby, upon rotary motion of said bomblet about said central longitudinal axis, said reflector is moved by centrifugal forces from said position of rest into said working position while said center of gravity moves in a curved path in a plane containing said central longitudinal axis; the improvement further comprising interengaging locking means for immobilizing said reflector in said working position.

2. A bomblet as defined in claim 1, wherein said reflector has an effective surface of paraboloidal configuration.

3. A bomblet as defined in claim 1, comprising a third guide arm forming a first guide arm pair with said first guide arm and a fourth guide arm forming a second guide arm pair with said second guide arm; the first and third guide arms together defining said first and second pivotal axes and said second and fourth guide arms together defining said third and fourth pivotal axes.

4. A bomblet as defined in claim 1, wherein the shortest distance between said first and second pivotal axes projected into a plane containing said central longitudinal axis and oriented perpendicularly to the pivotal axes is at the most 1.2 times greater than the shortest distance between said third and fourth pivotal axes projected into said plane.

5. A bomblet as defined in claim 1, wherein said locking means comprises a locking support affixed to said casing at a part thereof oriented towards the direction of said swinging motion and a countersupport affixed to said reflector at a part thereof oriented away from said direction of swinging motion in said position of rest of said reflector; said countersupport being in engagement with said locking support in said working position of said reflector.

6. A bomblet as defined in claim 5, wherein said locking support has a groove extending parallel to said pivotal axes and further wherein said countersupport has a tongue frictionally received in said groove for immobilizing said reflector relative to said casing in said working position.

7. A bomblet as defined in claim 6, wherein said locking means further comprises a leaf spring attached to said countersupport; said leaf spring constituting an additional securing element for immobilizing said reflector in said working position.

8. A bomblet as defined in claim 1, wherein in said position of rest of said reflector, the center of gravity thereof lies in a plane containing said central longitudinal axis and being oriented perpendicularly to said pivotal axes.

* * * * *